US007717608B2

(12) United States Patent
Liao

(10) Patent No.: US 7,717,608 B2
(45) Date of Patent: May 18, 2010

(54) SECTIONAL LIGHT-EMITTING-DIODE LAMP

(75) Inventor: Su-Hsien Liao, Taipei County (TW)

(73) Assignee: EIKO (Pacific) Ltd., Port Louis (MU)

( * ) Notice: Subject to any disclaimer, the term of this patent is extended or adjusted under 35 U.S.C. 154(b) by 160 days.

(21) Appl. No.: 12/125,065

(22) Filed: May 22, 2008

(65) Prior Publication Data

US 2009/0290382 A1 Nov. 26, 2009

(51) Int. Cl.
*F21S 4/00* (2006.01)

(52) U.S. Cl. ..... 362/640; 362/647; 362/649; 362/255; 362/294; 362/373

(58) Field of Classification Search ..... 362/640, 362/645, 646, 647, 649, 651, 658, 656, 255, 362/254, 264, 294, 373, 800; 315/51
See application file for complete search history.

(56) References Cited

U.S. PATENT DOCUMENTS 6,685,339 B2 * 2/2004 Daughtry et al. ..... 362/249.05
6,787,999 B2 * 9/2004 Stimac et al. ..... 315/51
7,226,189 B2 * 6/2007 Lee et al. ..... 362/294
7,559,674 B2 * 7/2009 He et al. ..... 362/249.02
2007/0230188 A1 * 10/2007 Lin ..... 362/294

* cited by examiner

*Primary Examiner*—Jacob Y Choi
(74) *Attorney, Agent, or Firm*—Pai Patent & Trademark Law Firm; Chao-Chang David Pai

(57) ABSTRACT

A sectional LED lamp includes a base portion, a lamp portion, and a connecting unit. The base portion includes a base body having an LED driving unit provided therein. The lamp portion includes a lamp body detachably connected at an end to the base body, a lampshade fitted around the lamp body, and at least one LED chip arranged in the lampshade and electrically connected to the lamp body. The connecting unit is located between two adjacent ends of the base body and the lamp body for electrically connecting the LED driving unit to the LED chip and detachably connecting the base portion to the lamp portion. A space is maintained between the base portion and the lampshade, allowing heat generated by the LED chip to quickly dissipate via the space into surround environment.

5 Claims, 5 Drawing Sheets

SECTIONAL LIGHT-EMITTING-DIODE LAMP

FIELD OF THE INVENTION

The present invention relates to an LED lamp, and more particularly, to a sectional LED lamp.

BACKGROUND OF THE INVENTION

A light-emitting-diode (LED) lamp has the advantages of high brightness, high reliability, extended usable life, and low power consumption, and therefore has been widely applied in different fields, such as signboards and general illumination.

Conventionally, an LED lamp includes a base portion and a lamp portion, with LED chips provided in the lamp portion. And, an LED driving unit is provided in the base portion for driving the LED chips to emit light.

The conventional LED lamp has a one-piece structure with integrally formed base portion and lamp portion. While the one-piece LED lamp enables convenient installation thereof, it has the following disadvantages in practical use thereof:

1. When emitting light, the LED lamp also generates a large quantity of heat. In the conventional one-piece LED lamp, the lamp portion and the base portion are not properly spaced from each other. Therefore, the heat generated by the LED lamp could not be effectively dissipated into surrounding air. As a result, the generated heat will stagnate in the LED lamp to adversely affect the lighting efficiency and usable life of the LED lamp.
2. In general, an LED chip has a long service life about fifty thousand hours. On the other hand, the LED driving unit is composed of various electronic elements and generally has a service life shorter than that of the LED chip. When the LED driving unit is damaged, the whole LED lamp will become useless and be discarded. That is, since the base portion and the lamp portion of the conventional LED lamp are integrally formed, when any one of the lamp portion and the base portion of the LED lamp is damaged, it is impossible to just replace the damaged lamp portion or base portion. Instead, the whole LED lamp must be discarded and replaced with a new one. This forms an unnecessary waste to increase the user's burden and does not meet the requirement for environmental protection.
3. Since the base portion and the lamp portion of the conventional LED lamp are integrally formed, it is impossible for a user to freely change the lamp portion to another one having a different shape, size, light color, etc.

Therefore, the conventional one-piece LED lamp has relatively poor applicability and design flexibility, and requires improvements.

SUMMARY OF THE INVENTION

A primary object of the present invention is to provide a sectional LED lamp that has independently replaceable lamp and base portions.

Another object of the present invention is to provide a sectional LED lamp that provides improved heat-radiating effect, good applicability, and high design flexibility.

A further object of the present invention is to provide a sectional LED lamp that is environment-friendly.

To achieve the above and other objects, the sectional LED lamp according to the present invention includes a base portion, a lamp portion, and a connecting unit. The base portion includes a base body having a first end and a second end opposite to the first end. An LED driving unit is provided in the base body, and a connecting terminal is provided at the first end of the base body and electrically connected to the LED driving unit and a power supply. The lamp portion includes a lamp body detachably connected to the base body and has a first end and a second end opposite to the first end. The first end of the lamp body is adjacent to the second end of the base body. The lamp portion further includes a lampshade fitted around the lamp body and having an open front end. At least one LED chip is arranged in a space defined in the open front end of the lampshade and electrically connected to the second end of the lamp body. The connecting unit is located between the second end of the base body and the first end of the lamp body for electrically connecting the LED driving unit to the LED chips, and detachably connecting the lamp portion to the base portion. After the base portion is connected to the lamp portion, a space is maintained between the second end of the base body and a rear end of the lampshade, so that heat generated by the LED chip may be effectively dissipated into surrounding air via the space between the base body and the lampshade.

In the sectional LED lamp of the present invention, the connecting unit preferably includes a coupling socket formed at the second end of the base body for accommodating the first end of the lamp body therein. The connecting unit further includes two slots spaced on a bottom of the coupling socket and electrically connected to the LED driving unit, and two conducting pins protruded from the first end of the lamp body and electrically connected to the LED chip. The conducting pins are inserted into the slots and electrically connected thereto.

In the sectional LED lamp of the present invention, the connecting unit preferably further includes at least one stopper located on an inner surface of the coupling socket and at least one wing portion formed on an outer surface at the first end of the lamp body. The stopper and the wing portion are engaged with each other to more firmly connect the lamp portion to the base portion when the first end of the lamp body is extended into the coupling socket.

In the sectional LED lamp of the present invention, it is preferable to form a plurality of spaced heat-radiating members on an outer surface of the lampshade to enable an enhanced heat-radiating effect.

In the sectional LED lamp of the present invention, it is preferable a transparent member is covered onto the open front end of the lampshade, allowing light emitted from the LED chip to pass through the transparent member.

In the sectional LED lamp of the present invention, it is preferable two watertight sealing members are separately mounted around the base body and the lamp body at joints between the connecting unit and the base body and the lamp body, such that the two watertight sealing members are pressed against each other in a water-tight relation when the lamp body is inserted into the coupling socket.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
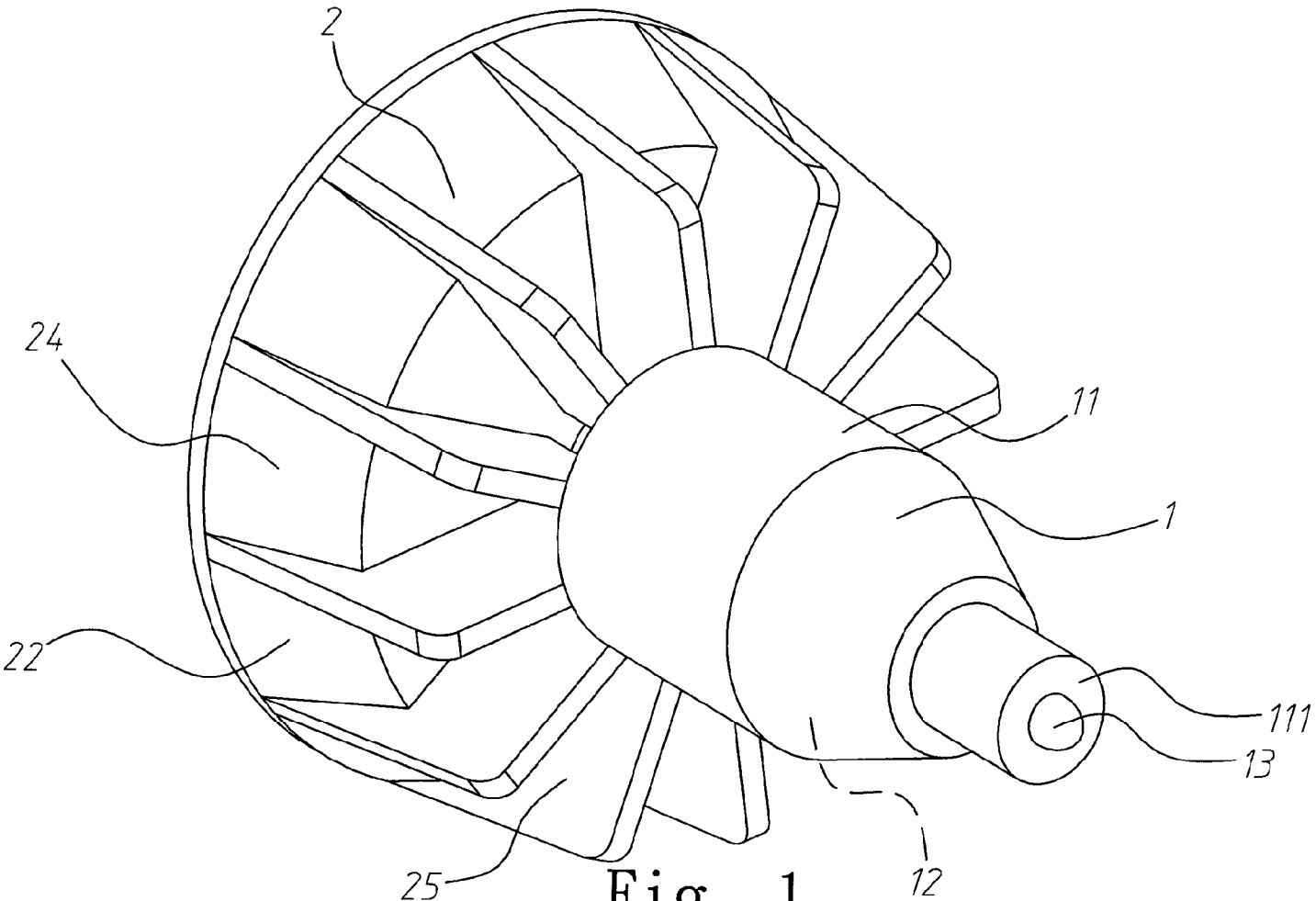
FIG. 1 is an assembled perspective view of a sectional LED lamp according to a preferred embodiment of the present invention.
Figure 2:
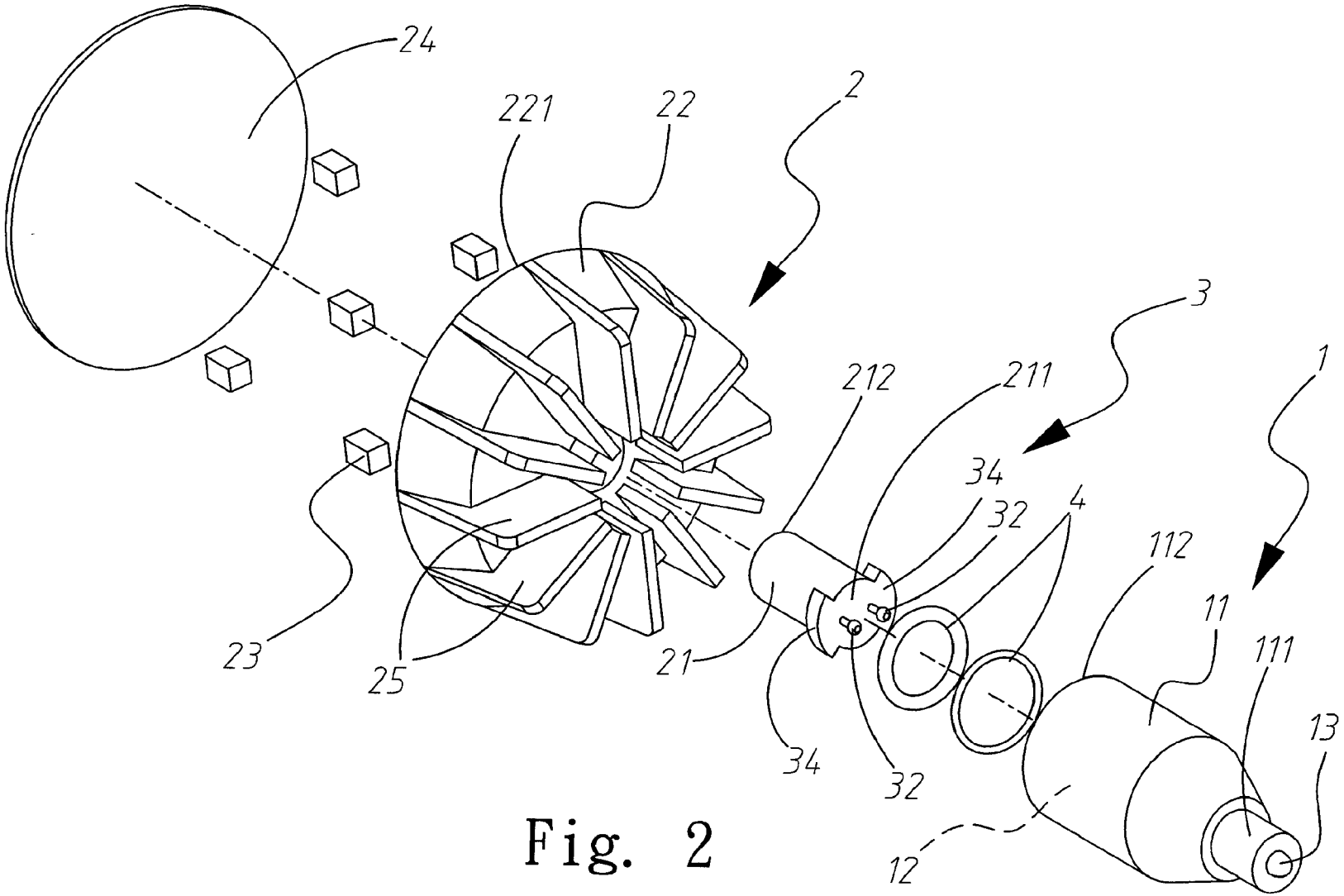
FIG. 2 is an exploded view of FIG. 1.
Figure 5:
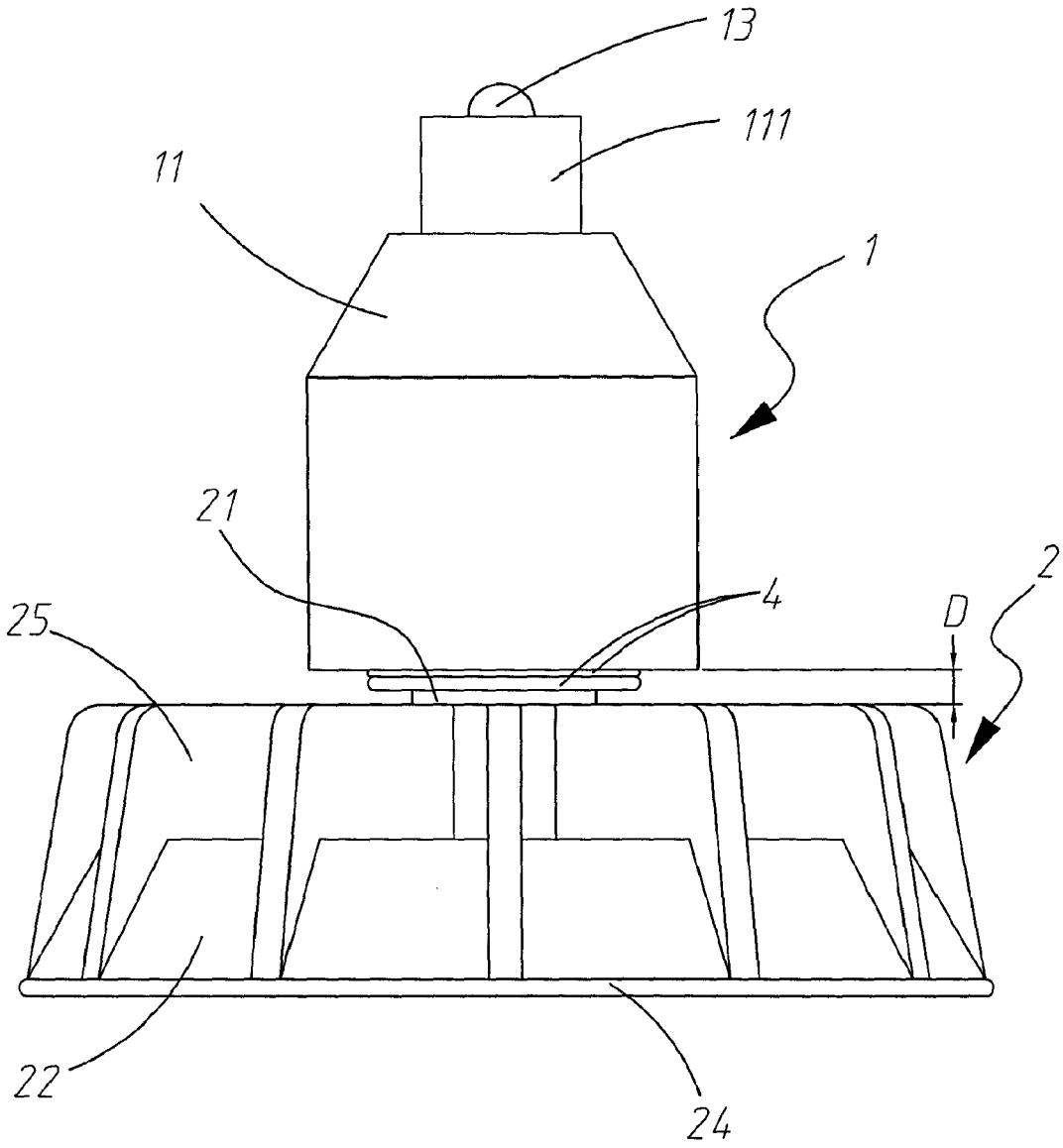
FIG. 5 is an assembled side view of the sectional LED lamp of the present invention.

Please refer to FIGS. 1, 2, and 5, in which a sectional LED lamp according to a preferred embodiment of the present invention is shown. As shown, the sectional LED lamp of the present invention includes a base portion 1, a lamp portion 2, a connecting unit 3, and two ring-shaped watertight sealing members 4.

Figure 3:
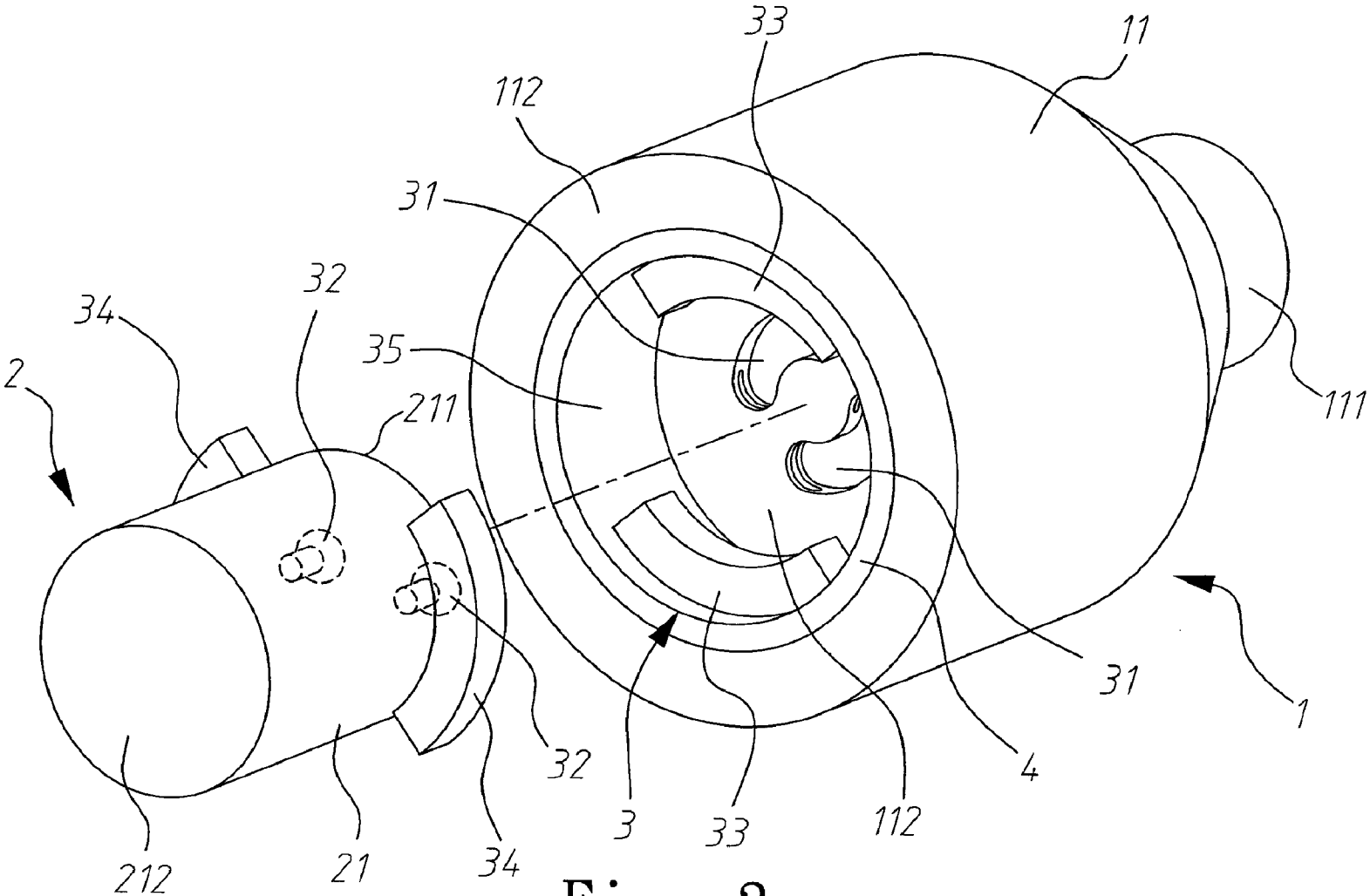
FIG. 3 is an exploded perspective view showing part of the sectional LED lamp of the present invention.
Figure 4:
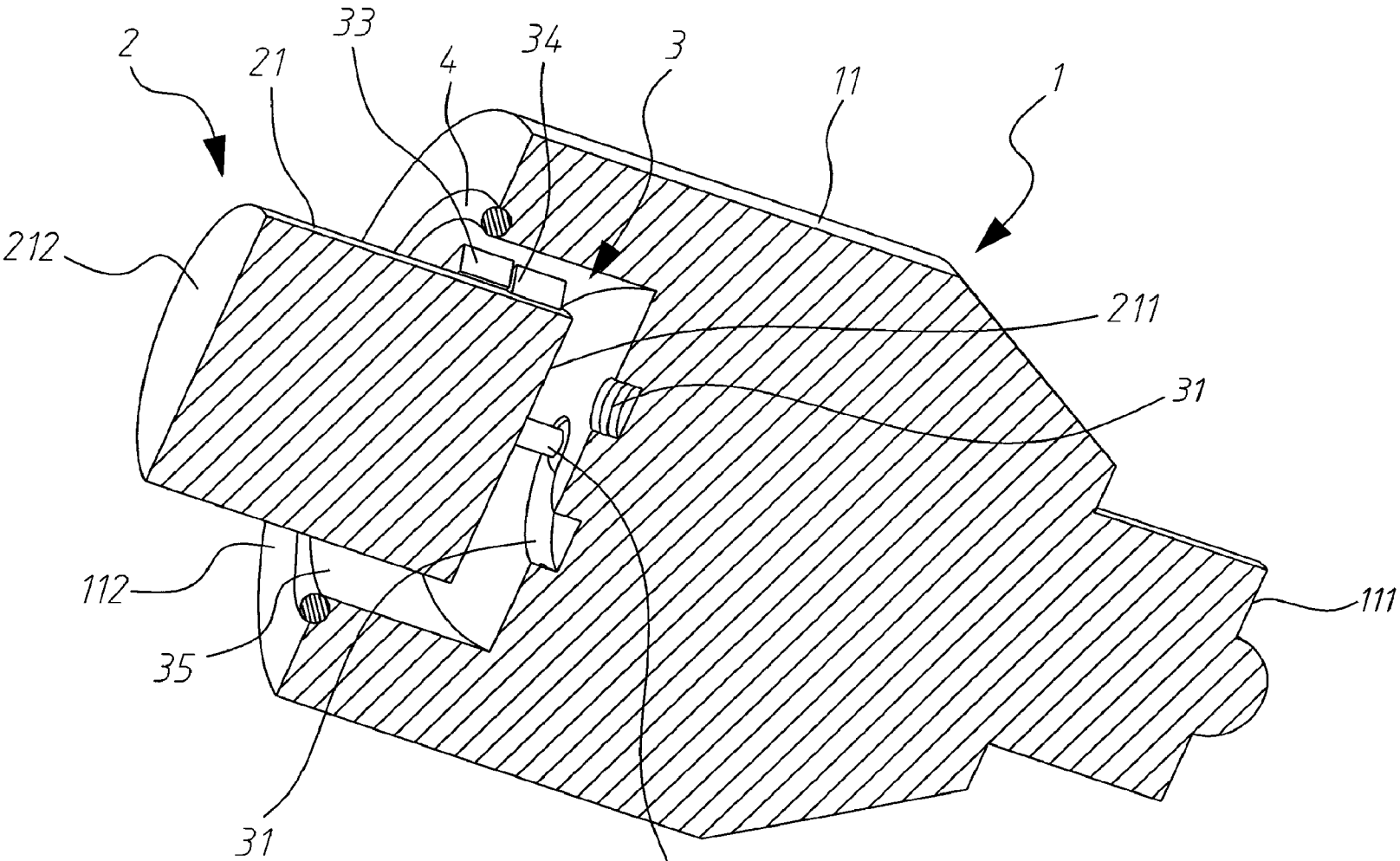
FIG. 4 is an assembled sectional view of FIG. 3.

Please also refer to FIG. 3. The base portion 1 includes a base body 11 having a first end 111 and a second end 112 opposite to the first end 111. An LED driving unit 12 is provided in the base body 11. A connecting terminal 13 is provided at the first end 111 and electrically connected to the LED driving unit 12 and a power supply (not shown).

The lamp portion 2 includes a lamp body 21, a lampshade 22, at least one LED chip 23, a transparent member 24, and a plurality of heat-radiating members 25.

The lamp body 21 is substantially cylindrical in shape, and has a first end 211 and a second end 212 opposite to the first end 211. The first end 211 is adjacent to the second end 112 of the base body 11 of the base portion 1.

The lampshade 22 is substantially in the form of a hollow truncated cone. The lampshade 22 is fitted around the lamp body 21 and has an open front end 221. In the illustrated preferred embodiment, the lampshade 22 is made of a heat-conducting metal material for reflecting light and radiating heat.

The LED chip 23 is arranged in a space defined in the open front end 221 of the lampshade 22 and electrically connected to the second end 212 of the lamp body 21. Power is supplied to the LED chip 23 from the power supply via the connecting terminal 13 on the base body 11 of the base portion 1, and is driven by the LED driving unit 12 to emit light. In the illustrated preferred embodiment, there are five LED chips 23. However, it is understood the number of the LED chips 23 and the color of light emitted from the LED chips 23 are changeable as necessary without being limited to the illustrated preferred embodiment.

The transparent member 24 is substantially a flat plate covered onto the open front end 221 of the lampshade 22, allowing the light emitted from the LED chips 23 to pass through the transparent member 24.

The heat-radiating members 25 are equally spaced on and connected to an outer surface of the lampshade 22 to give the lampshade 22 an increased heat-radiating surface area and accordingly, an enhanced heat-radiating effect. In the illustrated preferred embodiment, the heat-radiating members 25 are integrally formed on the outer surface of the lampshade 22 to radially extend outward and angular space from one another. However, the heat-radiating members 25 may be otherwise linearly arranged on the lampshade 22 or arranged in a combined manner with some linearly arranged and some radially arranged heat-radiating members 25 without being restricted to any specific manner of arrangement.

The connecting unit 3 is located between the second end 112 of the base portion 1 and the first end 211 of the lamp portion 2 for electrically connecting the LED driving unit 12 to the LED chips 23. In addition, the connecting unit 3 also detachably connects the lamp portion 2 to the base portion 1.

Referring to FIG. 3, the connecting unit 3 includes a coupling socket 35 formed at the second end 112 of the base body 11 for accommodating the first end 211 of the lamp body 21 therein; two spaced slots 31 formed on a bottom of the coupling socket 35 and electrically connected to the LED driving unit 12; and two conducting pins 32 protruded from the first end 211 of the lamp body 21 and electrically connected to the LED chips 23. The conducting pins 32 can be separately inserted into the two spaced slots 31 to electrically connect the LED driving unit 12 to the LED chips 23.

The connecting unit 3 further includes two stoppers 33 spaced on an inner surface of the coupling socket 1, and two wing portions 34 spaced on an outer surface at the first end 211 of the lamp body 21. When the conducting pins 32 are inserted into the slots 31, the wing portions 34 are at the same time engaged with the stoppers 33 to firmly connect the lamp portion 2 to the base portion 1. As can be seen from FIG. 5, after the base portion 1 is connected to the lamp portion 2, a space D is maintained between the second end 112 of the base body 11 and a rear end of the lampshade 22 of the lamp portion 2. With the space D, heat generated by the LED chips 23 can be more effectively dissipated into surrounding air.

To assemble the sectional LED lamp of the present invention, first place the first end 211 of the lamp body 21 in the coupling socket 35 on the base portion 1 with the conducting pins 32 inserted into the slots 31 on the base portion 1. Then, turn the lamp portion 2 to engage the wing portions 34 with the stoppers 33 in the coupling socket 35. At this point, the lamp portion 2 is firmly detachably connected to the base portion 1 and is electrically connected with the power supply via the base portion 1. Therefore, the LED chips 23 may be driven by the LED driving unit 12 to emit light.

By providing two separate base portion 1 and lamp portion 2 that can be detachably connected together via a connecting unit 3, the sectional LED lamp of the present invention provides the following advantages:

1. Improved heat-radiating effect: Since there is a space D maintained between the assembled base portion 1 and lamp portion 2, the heat generated by the LED chips 23 can be more effectively dissipated into surrounding environment via the space D. Therefore, the sectional LED lamp of the present invention is superior to the conventional one-piece LED lamp in terms of the heat-radiating effect.
2. Being environment friendly: In the event the base portion 1 or the lamp portion 2 is damaged, only the damaged portion needs to be replaced without discarding the whole LED lamp. Therefore, the sectional LED lamp of the present invention requires lower maintenance cost, has good applicability, and is environment-friendly.
3. Highly flexible in design: A variety of designs is available for the lamp portion 2. For example, the lamp portion may be changed in shape, size, light color, brightness, etc.

Moreover, to prevent damaged electronic elements in the base portion 1 of the sectional LED lamp due to invasion by water and moisture, the watertight sealing members 4 are separately disposed around the base body 11 of the base portion 1 and the lamp body 21 of the lamp portion 2 at joints between the connecting unit 3 and the base body 11 and the lamp body 21. After the lamp portion 2 and the base portion 1 are fully assembled, the two watertight sealing members 4 are tightly pressed against each other in a water-tight relation to prevent water from permeating into the LED lamp. In the illustrated preferred embodiment, the watertight sealing members 4 are made of a rubber material.

In brief, in the sectional LED lamp of the present invention, with the separate lamp portion and base portion detachably physically and electrically connected together via the connecting unit, the damaged lamp portion or base portion can be independently replaced to save cost and meet environmental protection, heat generated by the LED chips can be effectively dissipated, and the lamp portion may be flexibly designed. Moreover, the mounting of the watertight sealing members effectively protects internal electronic element against damage by invaded water to thereby ensure extended usable life of the sectional LED lamp.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A sectional LED lamp, comprising:

a base portion including a base body having a first end and a second end opposite to the first end, an LED driving unit provided in the base body, and a connecting terminal located at the first end of the base body and electrically connected to the LED driving unit and a power supply;

a lamp portion including a lamp body detachably connected to the base body, the lamp body having a first end and a second end opposite to the first end, the first end of the lamp body being adjacent to the second end of the base body; the lamp portion further including a lampshade fitted around the lamp body and having an open front end, and at least one LED chip arranged in a space defined in the open front end of the lampshade and electrically connected to the second end of the lamp body; and a connecting unit located between the second end of the base body of the base portion and the first end of the lamp body of the lamp portion for electrically connecting the LED driving unit to the LED chip, the connecting unit also detachably connected the lamp portion to the base portion with a predetermined space maintained between the second end of the base body and a rear end of the lampshade of the lamp portion;

wherein the connecting unit includes a coupling socket formed at the second end of the base body for accommodating the first end of the lamp body therein, two spaced slots formed on a bottom of the coupling socket and electrically connected to the LED driving unit, and two conducting pins protruded from the first end of the lamp body to insert into the two slots and electrically connected to the LED chip.

2. The sectional LED lamp as claimed in claim 1, wherein the connecting unit further includes at least one stopper formed on and protruded from an inner surface of the coupling socket, and at least one wing portion formed on an outer surface at the first end of the lamp body; and the stopper and the wing portion being engaged with each other when the first end of the lamp body is inserted into the coupling socket.

3. The sectional LED lamp as claimed in claim 1, wherein a plurality of heat-radiating members are spaced on and connected to an outer surface of the lampshade.

4. The sectional LED lamp as claimed in claim 3, wherein the open front end of the lampshade is covered by a transparent member.

5. The sectional LED lamp as claimed in claim 1, further comprising two watertight sealing members fitted around the base body of the base portion and the lamp body of the lamp portion at joints between the connecting unit and the base body and the lamp body, such that the two watertight sealing members are tightly pressed against each other in a watertight relation when the lamp body and the base body are assembled together, preventing water from invading into the assembled lamp body and base body.

* * * * *